United States Patent [19]

Klink

[11] Patent Number: 4,713,506

[45] Date of Patent: Dec. 15, 1987

[54] ELECTRICAL CONTACT MAKING ARRANGEMENT FOR MONITORING THE CONDITION OF A SCREW IN AN INSTALLED POSITION

[76] Inventor: Winfred Klink, Steinsdorfstrasse 1a, D-8000 München 22, Fed. Rep. of Germany

[21] Appl. No.: 840,739

[22] Filed: Mar. 18, 1986

[30] Foreign Application Priority Data

Mar. 20, 1985 [EP] European Pat. Off. ..... 85 103249.0

[51] Int. Cl.[4] ..... H01B 3/40

[52] U.S. Cl. ..... 200/158; 200/61.93; 200/336

[58] Field of Search ..... 200/158, 43.08, 336, 200/61.39, 61.4, 61.42, 61.43, 61.67, 61.68, 61.93, DIG. 8, DIG. 12

[56] References Cited

U.S. PATENT DOCUMENTS

| | | | |
|---|---|---|---|
| 2,579,623 | 12/1951 | Stanley | 200/158 |
| 3,644,745 | 2/1972 | Bell | 200/43.05 |
| 3,803,577 | 4/1974 | Peterson, II | 340/280 |
| 4,151,506 | 4/1979 | Schoenmetz | 200/158 |
| 4,329,681 | 5/1982 | Parsons | 340/568 |

FOREIGN PATENT DOCUMENTS

| | | | |
|---|---|---|---|
| 384191 | 11/1923 | Fed. Rep. of Germany . | |
| 550611 | 5/1932 | Fed. Rep. of Germany . | |
| 3110581 | 12/1982 | Fed. Rep. of Germany . | |
| 20603 | of 1893 | United Kingdom | 200/61.68 |
| 2095913 | 10/1982 | United Kingdom . | |

*Primary Examiner*—James E. Bryant, III
*Assistant Examiner*—Renee S. Luebke
*Attorney, Agent, or Firm*—Fleit, Jacobson, Cohn & Price

[57] ABSTRACT

An electrical contact making arrangement for monitoring the condition of a screw screwed in a screwthread or other material receiving same comprises contacts connected to a suitable alarm or warning circuit, and a bridging contact which makes or breaks a connection between the contacts to close or open the circuit when the screw is turned out of a reference set position thereof.The bridging contact is arranged on the shank of the screw, being electrically insulated at least with respect to the head of the screw, and extends peripherally over a given angle so that the circuit is opened or closed at a slight angle of rotary movement when the screw is turned out of the reference position thereof.

12 Claims, 8 Drawing Figures

FIG. 1
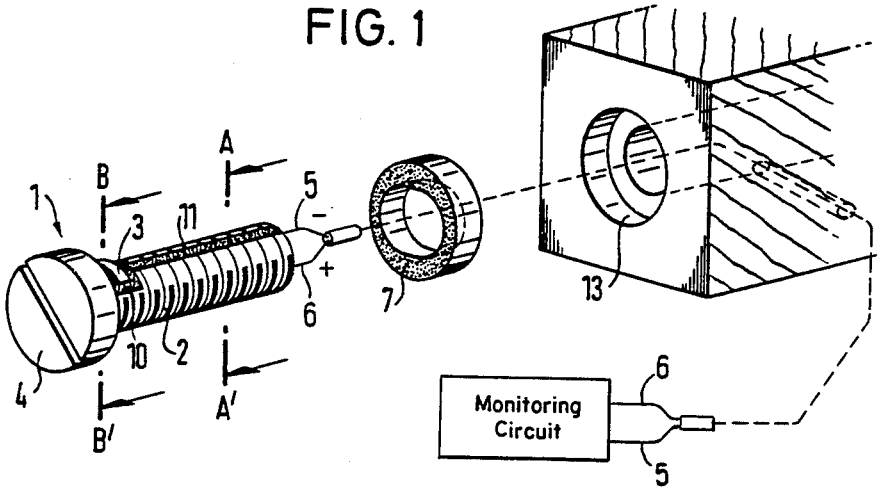
FIG. 2
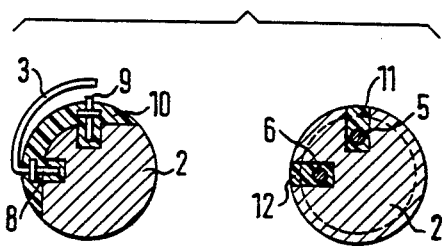
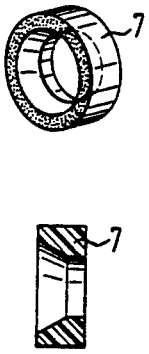
FIG. 4
FIG. 3
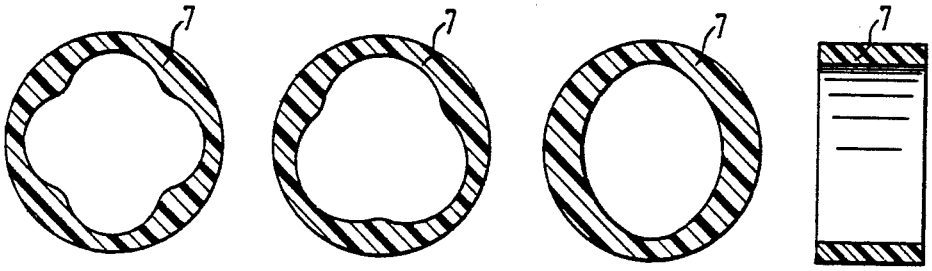

ELECTRICAL CONTACT MAKING ARRANGEMENT FOR MONITORING THE CONDITION OF A SCREW IN AN INSTALLED POSITION

BACKGROUND OF THE INVENTION

In an endeavour to render premises and property generally more resistant to theft, various forms of alarm device have been put forward, which operate on the principle of an alarm being given when an alarm-triggering member is moved from a given set position. Movement of the alarm-triggering member opens or closes a circuit connected to connecting contacts for triggering an alarm signal. An electrical contact making arrangement of that kind is disclosed for example in German patent specification No. 550 611, being used in a frame bar of an electrical protection grid or grating which is installed to protect premises from being broken into. The frame bar is made up of two halves and thus forms an outside conductor, with the two halves being secured together by means of screws. An inside conductor is formed by a bar member which is carried by one of the two halves of the frame bar. Disposed between the bar member and the halves of the frame bar are spacer sleeves of insulating material, through which pass screws which are prevented from contacting the bar member by means of insulating discs and are screwed into the halves of the frame bar. At given spacings the bar member has openings through which screws are passed. The diameter of those openings is approximately equal to the outside screwthread diameter of the screws passing therethrough so that the screwthread portion of each screw can still just be passed through the respective opening. That part of the shank of the screw which lies in the opening is provided with a peripheral groove so that between the shank of the screw and the bar member there is a sufficient clearance to prevent current from passing between the shank of the screw and the bar. If an attempt is made to remove the frame by taking it apart, then the screws, on being released, bridge the inside conductor formed by the bar member to the outside conductor formed by the frame bar, and an alarm signal is triggered off as a result.

However, that known construction is relatively expensive and complicated and further suffers from the disadvantage that parts thereof which carry current for the purposes of triggering off the alarm signal are readily accessible from the outside so that it is comparatively easy for the arrangement to be rendered inoperative.

German patent specification No. 384 191 discloses a switching means for triggering off an electrical alarm installation in the event of attempted theft of carpets, wall coverings and similar items in which the alarm contacts are covered by the covering material which is to be protected. The control members for the masked alarm contacts are control members which simulate carpet nails or carpet screws and which are not externally distinguishable from the carpet nails or carpet screws which are actually used for fixing the article in position. In the switching arrangement, the pin portion of the nail or the shank portion of the screw, on the head of the nail or screw respectively, is in the form of a switch rod around which is wound a coil spring for holding apart two alarm or connecting contacts which are connected to an electrical circuit. When the attempt is made to pull the nail or screw out, the switch rod on the head of the nail or screw compresses the spring and then the two alarm contacts also come into contact with each other, thereby triggering off the alarm signal.

That arrangement is also of a relatively complicated construction, together with the fact that, when the switch rod which is subjected to the loading of the spiral spring is pulled out, that loading means that the force required to pull out what is apparently a fixing nail or screw is different from the force required to pull out the normal fixing nails or screws. As a certain spacing must be provided between the two alarm contacts in order to ensure that the warning installation is not accidentally triggered off by the vibration due to the footsteps of someone walking on the floor, or the like, it is possible by carefully pulling out what is apparently a fixing nail or screw to ascertain whether it is or is not in fact a fixing screw or nail which serves only for fixing the article in position. In addition, there are no means for preventing that the switch rod and the head thereof are not current-carrying members while the alarm signal is being given.

SUMMARY OF THE INVENTION

An object of the present invention is to provide an electrical contact making arrangement for monitoring the set position of a screw and for triggering off an alarm signal upon an attempt being made to remove the screw, wherein the screw actually performs a fixing function.

Another object of the present inention is to provide an electrical contact making device for monitoring a fixing screw screwed into a means for receiving same, which while being of a simple configuration is extremely sensitive to movement of the screw out of its reference set position.

A further object of the present invention is to provide an electrical contact making arrangement for monitoring the condition of a screw screwed in a screw receiving means, which is substantially resistant to tampering in an attempt to render the warning system afforded thereby inoperative.

Still another object of the present invention is to provide an electrical contact making system for monitoring the position of a screw, which at least substantially eliminates the use of movable or delicate parts susceptible to tampering.

Yet another object of the present invention is to provide a screw arrangement for fixing purposes, which incorporates a warning system to warn of any attempt to rotate the screw beyond close limits out of a reference position.

In accordance with the principles of the present invention, these and other objects are attained by an electrical contact making arrangement for monitoring a screw which is screwed in a screwthread or in another fixing member or material, the arrangement being adapted upon removal of the screw from a reference position thereof to open or close a circuit connected to connecting contacts of the arrangement, for triggering a monitoring or alarm signal, by means of a bridging contact. The bridging contact is disposed on the shank portion of the screw and extends over a given angle in the peripheral direction thereof. In the region of the bridging contact, the shank portion of the screw is surrounded by a sleeve, ring or like member which cooperates with the bridging contact to produce the effect of opening and closing the circuit, upon rotational movement of the screw within the sleeve, ring or like member. Turning the screw out of a reference set position will thus open or close the circuit connected to the connecting contacts which are bridged by the bridging contact, thereby to trigger an alarm signal in appropriate circuitry.

The arrangement as set out above in accordance with the invention has the advantage that the monitoring or alarm signal is triggered off with just a slight rotary movement of the screw through an angle which can be less than 90°. That action is ensured by virtue of the fact that the two connecting contacts which are connected to the alarm circuitry are bridged by the bridging member by virtue of a rotational movement of the screw which is fully utilised for the purposes of displacing the bridging contact in relation to the connecting contacts, that being in contrast with the known contact arrangements in which axial displacement of the screw or the fixing pin is utilised.

The electrical contact making arrangement in accordance with the present invention can be used for monitoring or safeguarding machine screws which are screwed into a pre-bored hole with screwthread and also wood screws which are screwed into dowels, wall plugs or other soft material. It is also possible to use the arrangement in accordance with the invention in relation to screws which are fixed by a nut at the end of the shank of the screw.

Tampering with the arrangement from the outside is prevented by virtue of the insulated embedding of the contacts of the contact making arrangement or the bridging contact thereof, relative to the head of the screw. The circuit which is connected to the connecting contacts of the contact making arrangement may be a normally closed circuit or a normally open circuit. In the former case, the two connecting contacts are short-circuited by the bridging contact and the monitoring or alarm signal is triggered off when that contact between the connecting contacts is broken, upon rotation of the screw. If, when the arrangement uses a normally open circuit, the two connecting contacts are short-circuited by the bridging contact, by virtue of a rotary movement of the screw within a given angular range, the monitoring or alarm signal is then triggered off.

It should be appreciated that the invention may be effectively used not just in the area of alarm installations but also in the accident prevention and danger or hazard warning area.

Further objects, features and advantages of an arrangement in accordance with the principles of the present invention will be apparent from the following description of preferred embodiments of the invention.

BRIEF DESCRIPTION OF THE DRAWINGS

FIG. 1 shows a perspective view of a first embodiment, illustrating the individual components in a separated condition for the sake of enhanced clarity, FIG. 2 shows views of a shank portion of the screw of the FIG. 1 structure in section taken along lines A—A′ and B—B′ in FIG. 1, FIG. 3 shows various cross-sectional shapes in respect of the inside surface of the sleeve or ring member used in the FIG. 1 structure, FIG. 4 shows a further cross-sectional shape of the inside surface of the sleeve or ring member.

DESCRIPTION OF THE PREFERRED EMBODIMENTS

Figure 5:
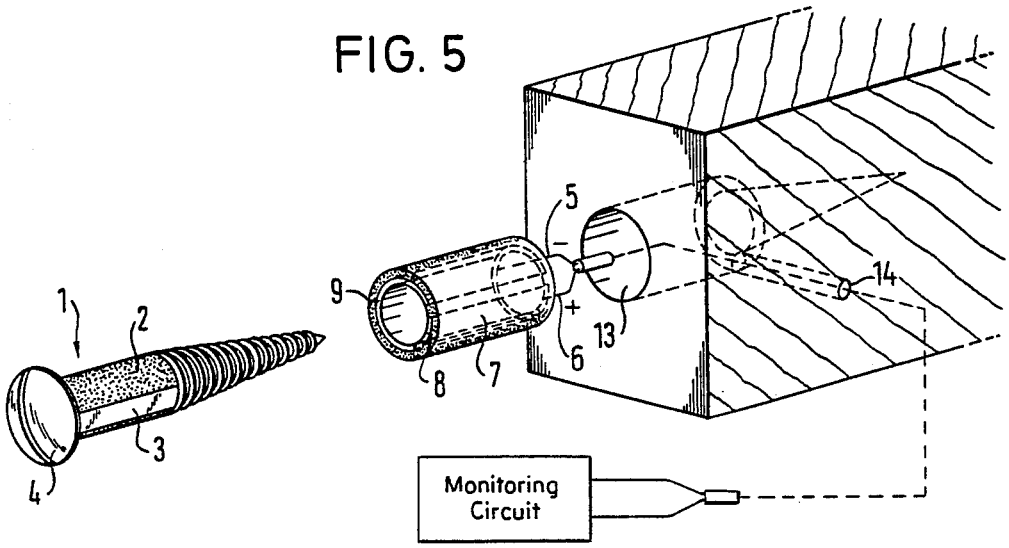
FIG. 5 shows a perspective view of another embodiment with the components once again shown in a separated condition for the sake of enhanced clarity.

Referring firstly to FIG. 1, shown therein is a first embodiment of the arrangement in accordance with the present invention, comprising a screw 1 which, illustrated in the form of a machine screw, can be screwed into a screwthread which is already formed for example in a nut or like member, or a sleeve embedded in holding material, to which the screw is to be screwed. In the installed condition, the contact making arrangement of the invention is disposed behind a head 4 of the screw 1 and is thus covered or masked thereby. As can be seen from the view in FIG. 2 which is taken in section along line B—B′ in FIG. 1, the contact making arrangement comprises a briding contact 3 in the form of a spring strip which is of an arcuately curved configuration thereby to adapt it to the outside peripheral surface of the shank 2 of the screw 1. In the region in which the contact making arrangement is carried on the shank 2 of the screw 1, the latter is preferably smooth. Adjoining same is then the screwthread on the shank portion 2 of the screw 1. The contact making arrangement further comprises two fixedly embedded connecting contacts 8 and 9 which are thus secured in the shank portion 2 of the screw 1, as can be most clearly seen from the sectional view on line B—B′ of FIG. 1, in FIG. 2. One end of the bridging contact 3 is fixedly connected to one of the connecting contacts, namely the contact 8 in FIG. 2, while the other end of the bridging contact 3 can be pressed against the other connecting contact 9 against the spring force of the spring strip 3, or moves away from the connecting contact 9 by virtue of the return spring force of the spring strip 3. FIG. 2 shows the condition of the arrangement in which the briding contact 3 is spaced from the connecting contact 9, thus opening the circuit to which the bridging contact 3 and the connecting contact 9 are connected, as will be described hereinafter.

The two connecting contacts 8 and 9, together with the bridging contact 3, are disposed in a plastic embedding material 10 which may also be another insulation embedding material, in a suitable recess on the shank portion 2 of the screw 1. That provides that the entire contact making arrangement consisting of the two connecting contacts 8 and 9 and the briding contact 3 is insulated from the remainder of the screw. In this embodiment therefore the contact making arrangement is insulated not only in relation to the head 4 of the screw but also in relation to the shank 2 of the screw.

FIG. 2 also shows a view of the shank 2 of the screw 1 in section taken along line A—A′. It will be seen therefrom that supply lines 5 and 6 which connect the connecting contacts 8 and 9 to a circuit are embedded in insulated manner beneath the screwthread of the screw 1, in grooves which are suitably provided for that purpose. The plastic embedding material 10 in the region of the sectional plane B—B′ provides for insulated embedding of the connecting contacts 8 and 9 and the bridging contact 3 in the shank 2 of the screw, while the plastic embedding portions 11 and 12 provide for insulating embedding of the lines 5 and 6 in the region of the screwthread on the shank 2 of the screw. A conventional electrical installation technique is used during insertion of screw 1 into recess 13. A guiding rope is connected to lines 5 and 6. The guiding rope is then pulled through bores 13 and 14 simultaneously as screw 1 is inserted into recess 13 to keep wires 5 and 6 from becoming entangled. Subsequently, wires 5 and 6 are connected to the monitoring circuit as shown in FIG. 1.

Referring again to FIG. 1, an actuating member shown in the form of a sleeve or ring 7 is disposed, in the assembled condition of the arrangement, around the portion of the shank 2 of the screw which carries the electrical contact making arrangement made up of the connecting contacts 8 and 9 and the bridging contact 3. The sleeve 7 serves as a deflector or motion-producing member for the purposes of actuating the bridging contact 3 when the screw is turned. The sleeve 7 is disposed in an enlarged recess 13 in the material or article into which the screw is fitted. The axis of the sleeve 7 is aligned with the axis of the bore into which the shank 2 of the screw is fitted. The sleeve 7 comprises insulating material, at least at is inside surface. It may also be made entirely of insulating material, for example plastic material.

Reference should now be made to FIG. 3 showing various cross-sectional configurations in respect of the inwardly facing surface of the sleeve 7, from which it will be apparent that the inwardly facing surface of the sleeve 7 acts effectively as a cam surface for displacing the bridging contact 3 in relation to the connecting contact 9 which is co-operable therewith, upon rotary movement of the screw. It will be noted from FIG. 3 that the inside surface of the sleeve 7 extends at least generally parallel to the axis thereof, as can be seen from the extreme right-hand sectional view in FIG. 3.

However, as shown in FIG. 4, it is also possible for a front portion of the inside surface of the sleeve 7, the front portion being therefore at the end from which the screw is fitted into the sleeve 7, to be of a conical configuration, thereby making it easier for the screw to engage into the sleeve 7 and thus into the bore behind same, in which the screw is to be screwed. Furthermore, upon rotary movement of the screw, the bridging contact 3 which is thus in the form of a spring-type contact can be actuated by the conical configuration of the inside surface of the sleeve 7. For the purposes of actuating the bridging contact 3, the inside surface of the sleeve 7 has projections which are produced for example, as in the case of the illustrated embodiments, by the cross-sectional configuration of the inside surface of the sleeve 7 differing from a circular form. It will be appreciated therefore that, when the bridging contact 3 in the form of a spring strip has at least its end portion which is adjacent the connecting contact 9, lying within a depression portion of the inside surface of the sleeve 7, such depression portion being formed by the inside surface of the sleeve 7 being deflected outwardly in relation to the body of the sleeve 7, then the free end portion of the bridging contact 3 is moved away from the connecting contact 9, which is the condition shown in the lefthand view in FIG. 2. When the screw 1 is rotated through a small angle which is for example a quarter of a revolution, a third of a revolution or a half of a revolution, then the free end of the bridging contact 3 is pressed against the connecting contact 9 by virtue of the free end portion of the bridging contact cooperating with a raised or radially inwardly disposed portion of the inside surface of the sleeve 7, so that the two connenting contacts 8 and 9 are short-circuited thereby. In that way, a monitoring or alarm signal can be triggered off.

It is also possible however for the free end of the bridging contact 3 to be pressed into contact with the connecting contact 9 by virtue of the free end of the bridging contact 3 co-operating with a raised or radially inwardly disposed portion of the inside surface of the sleeve 7, when the screw is in the desired or reference set position. When then the screw is turned out of that reference set position, then the bridging contact 3 passes into an outwardly displaced portion of the inside surface of the sleeve 7, whereby the bridging contact 3 is moved away from the connecting contact 9, the previously normally closed circuit is opened and a signal is triggered off thereby.

Reference will now be made to FIG. 5 showing another embodiment of the arrangement, for use in relation to a screw of a different configuration, namely a wood screw. The screw can thus be screwed into a plug, dowel or like relatively soft material.

In this construction, adjoining the head 4 of the screw 1, the shank 2 of the screw has a shank portion with a smooth surface. Conductive and electrically insulating surface portions are provided alternately on the surface of that shank portion, in the peripheral direction thereof. It is also possible for the screw to have only one conductive portion extending over a given angular region, with the remainder of the periphery of the shank of the screw being of an electrically insulating nature.

The one or more conductive surface portions of the shank of the screw act as the bridging contact 3. The shank 2 of the screw 1 is surrounded by the sleeve or ring 7 in the axial region of the bridging contact portion or portions 3. In this embodiment therefore the connecting contacts 8 and 9 of the contact making arrangement, which are connected to a suitable circuit, are disposed at the inside surface of the sleeve 7. The sleeve itself is formed from electrically insulating material, for example plastic material. Preferably, the electrically insulating material is translucent or transparent.

As will be appreciated from viewing FIG. 5, the sleeve 7 is fitted into the recess 13 which is disposed in alignment with the hole in which the screw 1 is to be screwed. A bore 14 may be disposed in communication with the recess 13, extending inclinedly away therefrom, through which the insulated lines or wires 5 and 6 pass to the circuit (not shown).

In the embodiment illustrated in FIG. 5, the connecting contacts 8 and 9 carried on the inside surface of the sleeve 7 are in the form of electrically conductive surface portions. As can be seen in particular from the cross-sectional shape of the sleeve 7 shown in FIG. 7, the electrically conductive surface or coating which forms the connecting contact 9 extends over a relatively large angular area of for example of about 270°. The other electrically conductive surface portion or coating which forms the connecting contact 8 extends over an angular range of less than 90°, with insulating portions 15 and 16 thus occurring between the two electrically conductive surface portions 8 and 9.

Figure 6:
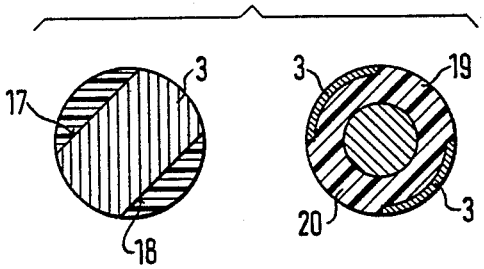
FIG. 6 shows views in cross-section of possible constructions of the shank of the screw.

FIG. 6 shows possible cross-sectional configurations of the shank of the screw in the region of the one or more bridging contacts 3. In one construction, as shown at the left-hand side in FIG. 6, the metal shank of the screw is provided over a portion of the length thereof with flat surface portions thus defining segment-shaped recesses 17 and 18 into which portions of insulating material are fitted to make up a round cross-section for the shank of the screw. The conductive surface portions are thus formed by the surface portions of the metal shank portion of the screw, that remain between the insulating material portions fitted into the recesses 17 and 18; those conducting surface portions then represent the bridging contacts 3. However, instead of that arrangement, it is also possible for a plastic foil provided with metallisation strips to be shrink fitted on to the shank of the screw.

In the further embodiment which is shown at the right in FIG. 6, there are insulating surface coating portions 19 and 20 which have the bridging contacts 3 in relatively shallow depressions therein.

In yet another modified embodiment however it is also possible for the metal peripheral surface of the shank of the screw to be completely provided with an insulating covering or coating, with one or more surface portions which are electrically conductive being formed thereon, for example by vapour deposit of a metallisation portion. That arrangement then provides for insulation of the metal screw head 4. That effect may also be achieved by an insulating material which fills or makes up the entire cross-section of the shank 2 of the screw being provided between the shank 2 and the head 4 of the screw.

Figure 7:
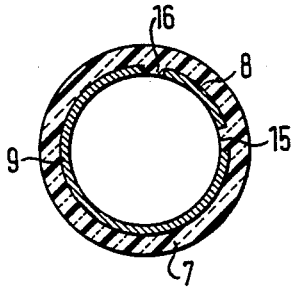
FIG. 7 is a view in cross-section of an embodiment of the sleeve member.
Figure 8:
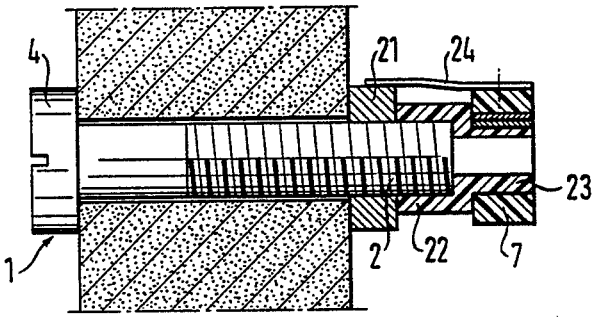
FIG. 8 shows a sectional side view of another embodiment.

In the embodiment shown in FIG. 8, the screw 1 is screwed with its screwthread into a nut 21. The sleeve 7 which may be of the same configuration as the sleeve shown in FIGS. 5 and 7, is disposed near the end of the shank 2 of the screw. Disposed on the portion of the shank 2 of the screw which projects beyond the nut 21 is a projection or attachment member 22 which is non-rotatably connected to the shank 2 of the screw. The portion 23 of the member 22, which is fitted into the sleeve 7, is also provided at its surface with at least one conductive surface portion which acts as the bridging contact 3, as will be described hereinafter. The sleeve 7 is prevented from rotating relative to the member into which the screw 1 is screwed, and for that purpose may be fixed to the nut 21 for example by means of a holding clip 24. However the sleeve 7 may also be prevented from rotating by way of the holding clip 24, by engaging the material through which the screw 1 is passed. Nut 21 is prevented from rotating relative to the member into which screw 1 is screwed under the effect of friction. Alternatively, lock washer may be used to prevent nut 21 from rotating relative to the member, or nut 21 may be welded or formed integrally with the member.

If, in the case of the embodiments shown in FIGS. 5 and 8, the bridging contact 3 is disposed exclusively in the region of the connecting contact 9 formed by a surface portion, then the circuit is opened, If, upon rotary movement of the screw, the two connecting contacts 8 and 9 are connected or short-circuited by the bridging contact 3, then an alarm or monitoring signal is triggered off.

In the situation where the circuit is in the form of a normally closed circuit, the two connecting contacts 8 and 9 formed by surface portions are connected together by the bridging contact 3 in the reference set position of the screw, whereby the circuit is in a closed condition. When the screw is rotated however, bridging contact 3 moves out of its bridging position in which it interconnects the connecting contacts 8 and 9 whereby the circuit is opened thus triggering off the alarm or monitoring signal.

It will be appreciated that the constructions described hereinbefore with reference to the accompanying drawings are set forth solely by way of non-limiting example of the principles of the invention and various modifications and alterations may be made therein without thereby departing from the scope and spirit of the invention. For example, the inside surface configurations of the sleeve 7, as shown in FIG. 3, having one or more projectiions thereon or being of an elliptical configuration or being of a conically convergent configuration as shown in FIG. 4, may be further modified to provide the desired effect of actuating the spring strip bridging contact 3.

I claim:

1. An electrical contact making arrangement for monitoring an angular position of a screw in an installed position thereof, the screw including at least a shank with a screw thread on at least a part thereof, the arrangement comprising first and second connecting contact means for connection to a monitoring circuit, a bridging contact on a portion of the shank of the screw extending in a peripheral direction thereof over only part of the periphery thereof, and a member disposed in an installed position of the arrangement around the portion of the shank having the bridging contact, the member moving the bridging contact to open and close the circuit when the screw is turned out of a reference set position.

2. An arrangement as set forth in claim 1 wherein said screw has a head and said bridging contact is electrically insulated at least with respect to the head of the screw.

3. An arrangement as set forth in claim 1 and operable to actuate said circuit when said screw is rotated through an angle of less than 360° from its said reference set position.

4. An arrangement as set forth in claim 1 wherein said bridging contact is a spring strip providing a spring force and having a first end secured to the shank of the screw and connected to one said connecting contact means disposed on said shank and having a second end which is a free end, and wherein the other said connecting contact means is disposed on said shank to co-operate with said second end of said spring strip, said member disposed around said portion of the shank having a surface facing towards said portion of the shank, said surface at least comprising insulating material and co-operating with said second end to bring it selectively into contact with the other said connecting contact means against the spring force of said spring strip.

5. An arrangement as set forth in claim 4 including lines connected to said connecting contact means disposed on the shank of the screw for connection to said circuit, said lines being in recessed relationship in the shank with respect to the screw thread thereon and embedded insulatedly with respect to said shank.

6. An arrangement as set forth in claim 4 wherein said surface of said member is of a generally circular cross-section with at least one projection therein for displacing said second end of said bridging contact.

7. An arrangement as set forth in claim 4 wherein said surface of said member is at least partially of a conically convergent configuration in a direction of insertion of the screw into the member.

8. An arrangement as set forth in claim 4 wherein said surface of said member is of a cross-sectional shape which differs from a circular shape.

9. An arrangement as set forth in claim 8 wherein said cross-sectional shape of said surface of said member is elliptical.

10. An electrical contact making arrangement for monitoring an angular position of a screw in an installed position thereof, the screw including at least a shank with a screw thread on at least a part thereof, the arrangement comprising first and second connecting contact means for connection to a monitoring circuit, a bridging contact on a portion of the shank of the screw extending in a peripheral direction thereof over only a part of the periphery thereof, and a member disposed in an installed position of the arrangement around the portion of the shank having the bridging contact, the member cooperating with the bridging contact to open and close the circuit when the screw is turned out of a reference set position, wherein said member is a sleeve and further including an attachment member fixed to a projecting end portion of the shank of the screw non-rotatably relative thereto and having a portion in the installed position extending into said sleeve, said attachment member carrying said bridging contact on a part of its peripheral surface which engages said sleeve, wherein said sleeve carries said connecting contact means at its inside surface and is non-rotatably fixed with respect to material through which the shank of the screw is passed.

11. An electrical contacting arrangement for monitoring a condition of a screw in an installed position thereof, the screw comprising at least a shank with a screw thread on at least a part of the shank, the arrangement including: an actuating member adapted to extend at least partly around the shank of the screw in the installed position of the screw; first and second connecting contact means carried by the screw and adapted for connection to an electrical monitoring circuit; and a bridging contact carried on the shank of the screw and extending over a given angular region in a peripheral direction thereof, the bridging contact co-operating with said actuating member and being displaced as the screw is turned by said actuating member relative to said first and second connecting contact means between a first position of making an electrical connection between same and a second position of breaking the electrical connection between same, whereby as the screw is turned out of a reference position thereof a condition of connection of said connecting contact means is altered, thereby altering a state of said circuit connected thereto.

12. An electrical contacting arrangement for monitoring an angular position of a screw in an installed position thereof, the screw comprising at least a shank with a screw thread on at least a part of the shank, the arrangement including: a carrier member extending at least partly around the shank of the screw in the installed position thereof; first and second connecting contact means carried by said carrier member for connection to an electrical monitoring circuit; and a bridging contact carried by the shank of the screw and extending over only a partial angular region in a peripheral direction thereof, a bridging contact being adapted to co-operate for selective electrical contacting with said first and second connecting contact means, a condition of contacting co-operation between said bridging contact and said first and second connecting contact means being changed by rotary movement of the screw out of a reference set position thereof, thereby altering a state of said circuit connected thereto.

* * * * *